United States Patent [19]

Yamamoto et al.

[11] Patent Number: 4,920,766

[45] Date of Patent: May 1, 1990

[54] RECEIVER FOR REFRIGERANT APPARATUS

[75] Inventors: Yuji Yamamoto; Kanichi Shiina; Toshinori Tokutake, all of Tochigi, Japan

[73] Assignee: Showa Aluminum Corporation, Sakai, Japan

[21] Appl. No.: 401,689

[22] Filed: Sep. 1, 1989

[30] Foreign Application Priority Data

Sep. 5, 1988 [JP] Japan ..... 63-222161

[51] Int. Cl.[5] ..... F25B 43/00

[52] U.S. Cl. ..... 62/474; 62/509; 285/137.1; 285/377

[58] Field of Search ..... 62/474, 509; 285/137.1, 285/362, 377

[56] References Cited

U.S. PATENT DOCUMENTS

| | | | |
|---|---|---|---|
| 2,911,200 | 11/1959 | Gardner et al. | 285/137.1 X |
| 3,212,289 | 10/1965 | Bottum | 62/509 X |
| 3,512,806 | 5/1970 | Romney et al. | 285/137.1 |
| 3,545,227 | 12/1970 | Grahl | 62/474 |
| 3,842,870 | 10/1974 | Burgess | 285/137.1 X |
| 4,382,618 | 5/1983 | Grisebach | 285/137.1 |
| 4,707,999 | 11/1987 | Ohta et al. | 62/474 |
| 4,759,462 | 7/1988 | Neglio | 285/137.1 X |

*Primary Examiner*—William E. Tapolcai
*Attorney, Agent, or Firm*—Armstrong, Nikaido, Marmelstein, Kubovcik & Murray

[57] ABSTRACT

A receiver comprising a closed tank having a top wall with a planar upper surface. The top wall is formed with a blind screw bore and two refrigerant channels each having an outer end opened at the wall upper surface and an enlarged portion at the outer end. Inlet and outlet refrigerant pipes are connected to the top wall and inserted each at its one end in the respective channels. Each refrigerant pipe has an annular projection formed on its outer periphery over the entire circumference thereof and fitted in the channel enlarged portion. A fixing plate having a planar lower surface is disposed over the wall upper surface for fixing the pipes to the top wall. The fixing plate is formed with a screw hole, two circular holes each having a diameter approximately equal to the outside diameter of the annular projection for the projection to pass therethrough, and pipe inserting circular-arc cutouts extending from the respective circular holes in the same circumferential direction so as to be positioned on a circle concentric with the screw hole when seen from above and having a width not permitting the projection to pass therethrough. The fixing plate is fastened to the top wall with a screw driven through the screw hole into the blind screw bore.

7 Claims, 6 Drawing Sheets

RECEIVER FOR REFRIGERANT APPARATUS

BACKGROUND OF THE INVENTION

The present invention relates to receivers for use in refrigerating apparatus such as motor vehicle air conditioners.

Such receivers already known include the one disclosed in U.S. Pat. No. 4,707,999. Briefly stated, the disclosed receiver comprises a closed tank having a top wall with a planar upper surface, the top wall being formed with two blind screw bores and two refrigerant channels each having an outer end opened at the upper surface of the top wall and an enlarged portion at the outer end, inlet and outlet refrigerant pipes connected to the top wall and inserted each at its one end in the respective refrigerant channels, block joints for fixing the respective refrigerant pipes to the top wall, and two screws extending through the respective block joints and screwed into the respective blind screw bores for fastening the block joints to the top wall. The refrigerant pipes extend through the respective block joints individually. Each of the pipes has an annular bead formed on the outer periphery of the portion thereof projecting beyond the block joint toward the top wall, extending over the entire circumference of the pipe and fitted in the enlarged portion of the refrigerant channel.

With the receiver described above, however, the two refrigerant pipes need to be connected to the top wall with the separate block joints individually by a cumbersome procedure. Moreover, a union screw, union flange or like joint member must be attached to the forward end of each refrigerant pipe, so that there is a need to form the annular bead after the pipe has been passed through the block joint. The bead is therefore difficult to form because of the presence of the block joint as an obstacle.

SUMMARY OF THE INVENTION

The main object of the present invention is to provide a receiver free of the above problems.

More specifically, the present invention provides a receiver comprising a closed tank having a top wall with a planar upper surface, the top wall being formed with a blind screw bore and two refrigerant channels each having an outer end opened at the upper surface of the top wall and an enlarged portion at the outer end; inlet and outlet refrigerant pipes connected to the top wall and inserted each at its one end in the respective refrigerant channels, each of the refrigerant pipes having an annular projection formed on its outer periphery over the entire circumference thereof and fitted in the enlarged portion of the refrigerant channel; a pipe fixing plate having a planar lower surface and disposed over the upper surface of the top wall for fixing the refrigerant pipes to the tank top wall, the pipe fixing plate being formed with a screw hole, two circular holes each having a diameter approximately equal to the outside diameter of the annular projection for the annular projection to pass therethrough, and pipe inserting circular-arc cutouts communicating with the respective circular holes each at a peripheral portion of the hole and extending in the same circumferential direction about the screw hole so as to be positioned on a circle concentric with the screw hole when seen from above, each of the circular-arc cutouts having a width not permitting the annular projection to pass therethrough; and a screw extending through the screw hole of the pipe fixing plate and screwed into the blind screw bore in the top wall for fastening the pipe fixing plate to the tank top wall; the angle made by a line through the center of one of the circular holes in the pipe fixing plate and the center of the screw hole therein with a line through the forward end of the cutout communicating with said one circular hole and the center of the screw hole being greater than the angle made by a line through the center of the other circular hole in the pipe fixing plate and the center of the screw hole with a line through the center of one of the refrigerant channels in the top wall and the center of the screw hole when said one circular hole is positioned immediately above the outer end of the other refrigerant channel.

The inlet and outlet refrigerant pipes can be fixed to the top wall in the following manner. First, with the pipe fixing plate rendered free to rotate by slightly loosening the screw, the fixing plate is rotated to position one of the circular holes immediately above one of the refrigerant channels, and the inner end of one of the refrigerant pipes is inserted into this refrigerant channel. Further when the other circular hole is positioned immediately above the other refrigerant channel, the other refrigerant pipe is inserted through the circular hole into the other refrigerant channel. The pipe fixing plate is thereafter rotated to move the refrigerant pipes through the respective cutouts. At this time, the two pipes are temporarily held by the annular projection of each pipe being pressed on by the inner and outer side edges of the cutout portion. In this state, each refrigerant pipe is free to rotate about the axis of the refrigerant channel, so that the outer end of the pipe can be oriented in the desired direction. Finally, the pipe fixing plate is fastened to the top wall by tightening up the screw to thereby fix the two refrigerant pipes to the top wall. Accordingly, the refrigerant pipes, each having the annular projection, can be connected to the respective refrigerant channels in the top wall after the pipe fixing plate has been attached to the top wall. This facilitates formation of the annular projection. Moreover, the pipes can be fixed to the top wall easily since the single fixing plate needs only to be fastened to the top wall. The refrigerant pipe outer end can be oriented toward the desired direction before the fixing plate is fastened to the top wall. This affords greater freedom in fabricating the piping system concerned.

Further with the receiver of the present invention, the forward end of each pipe inserting cutout has a circular-arc form in conformity with the outer periphery of the refrigerant pipe. The first-mentioned angle is equal to the second-mentioned angle plus the angle made by the line through the center of said other circular hole and the center of the screw hole with a line through the forward end of the cutout communicating with said other circular hole and the center of the screw hole. When fixed in place, each refrigerant pipe is therefore positioned in the forward end of the cutout with its outer periphery partly in intimate contact with the forward end of the cutout portion. The annular projection of the pipe is pressed on by the inner and outer side edges and the circular-arc end edge of the cutout portion. Consequently, the pipe is fixed in place with increased strength.

The present invention will be described in greater detail with reference to the accompanying drawings.

DESCRIPTION OF THE PREFERRED EMBODIMENTS

Figure 1:
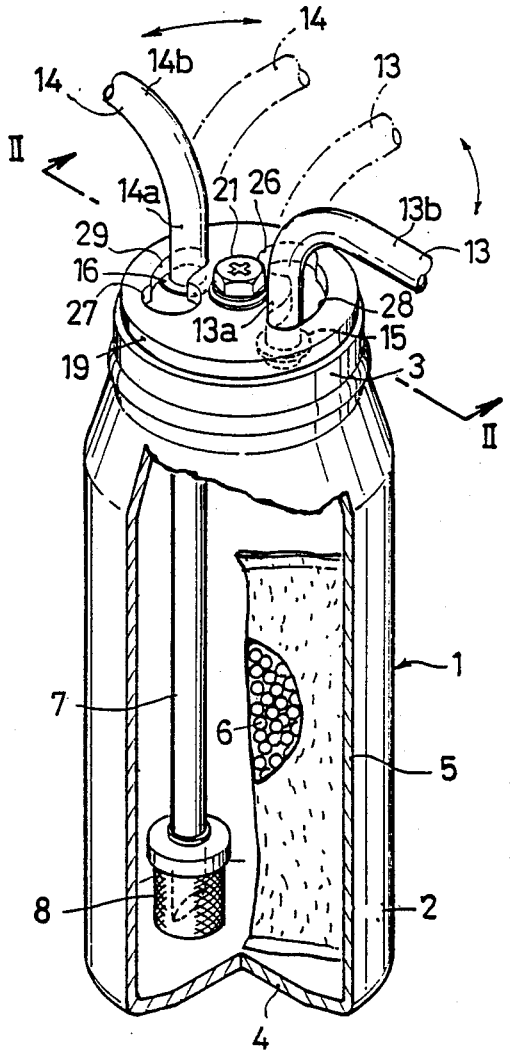
FIG. 1 is a perspective view partly broken away and showing a receiver embodying the invention, with refrigerant pipes fixed to the top wall of a closed tank.

Throughout the drawings, like parts are designated by like reference numerals and will not be described repeatedly.

Figure 2:
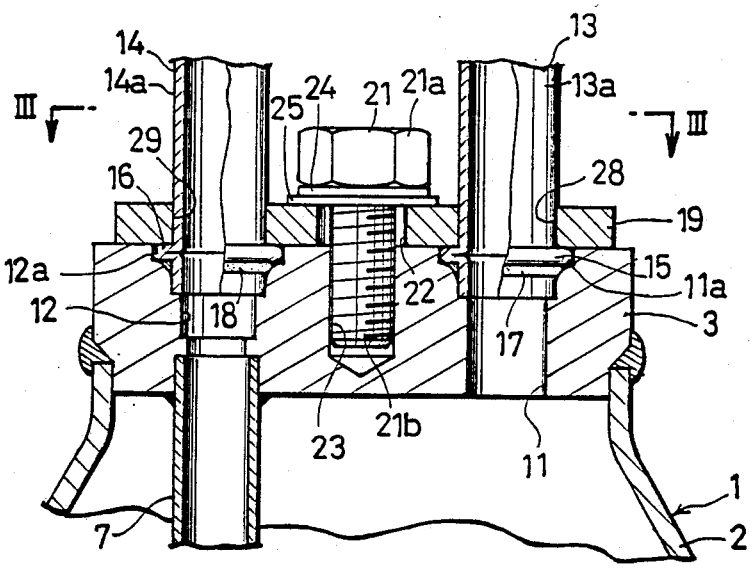
FIG. 2 is an enlarged fragmentary view in section taken along the line II—II in FIG. 1.
Figure 3:
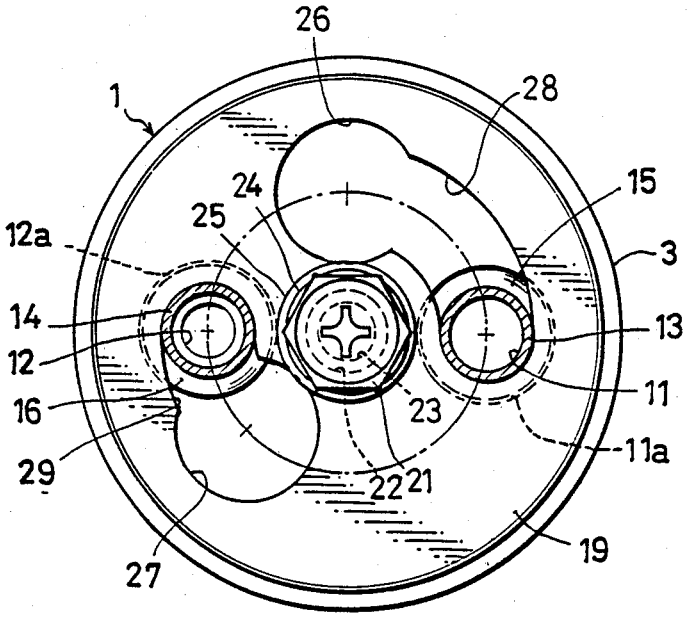
FIG. 3 is a view in section taken along the line III—III in FIG. 2.

With reference to FIGS. 1 to 3 showing a receiver embodying the present invention, the receiver includes a closed tank 1 in the form of a vertical hollow cylinder closed at its opposite ends. The tank 1 comprises a tank body 2 in the form of a vertical hollow cylinder and having a closed lower end and an open upper end, and a top wall 3 secured to the upper end of the tank body 2 as by welding to close the open upper end and having a planar upper surface. The bottom wall 4 of the tank 1 is integral with its peripheral wall 5. Provided inside the tank 1 are a drying agent 6 placed in a cloth bag, and a vertical tube 7 for aspirating a refrigerant. The aspirating tube 7 has a strainer 8 attached to its lower end.

The top wall 3 is formed with an inlet refrigerant channel 11 and an outlet refrigerant channel 12 extending vertically therethrough and each having an upper end opened at the upper surface of the top wall 3. The channels 11, 12 are circular in cross section and have enlarged portions 11*a*, 12*a*, respectively, at their upper ends. An inlet refrigerant pipe 13 is connected to the inlet channel 11 of the top wall 3, and an outlet refrigerant pipe 14 to the outlet channel 12 of the wall 2. Each of the refrigerant pipes 13, 14 comprises a vertical portion 13*a* (14*a*) and a horizontal portion 13*b* (14*b*) extending from the upper end of the vertical portion 13*a* (14*a*). Each of the vertical portions 13*a*, 14*a* has an annular projection 15 (16) formed over the entire circumference thereof by beading and positioned at a specified distance upward from its lower end. The vertical portion 13*a* (14*a*) of the refrigerant pipe 13 (14) is inserted, at the part thereof not higher than the annular projection 15 (16), in the refrigerant channel 11 (12), with the annular projection 15 (16) fitted in the enlarged portion 11*a* (12*a*). An annular seal 17 (18) is fitted around each pipe 13 (14) at one side of the annular projection 15 (16) closer to the pipe inner end, in intimate contact with the projection 15 (16) and the wall inner periphery defining the enlarged portion 11*a* (12*a*). The upper end of the aspirating tube 7 is inserted in the outlet refrigerant channel 12 and secured to the top wall 3 by welding.

The two refrigerant pipes 13, 14 are fixed to the top wall 3 by a pipe fixing plate 19 having a planar lower surface and fastened to the upper surface of the tank top wall 3 with a screw 21. The screw 21 extends through a circular screw hole 22 formed in the fixing plate 19 centrally thereof and is screwed into a blind screw bore 23 formed in the upper surface of the top wall 3 centrally thereof. A washer 24 and a plate holding member 25 are provided between the head 21*a* of the screw 21 and the plate 19 and fitted around the screw shank 21*b*.

Figure 4:
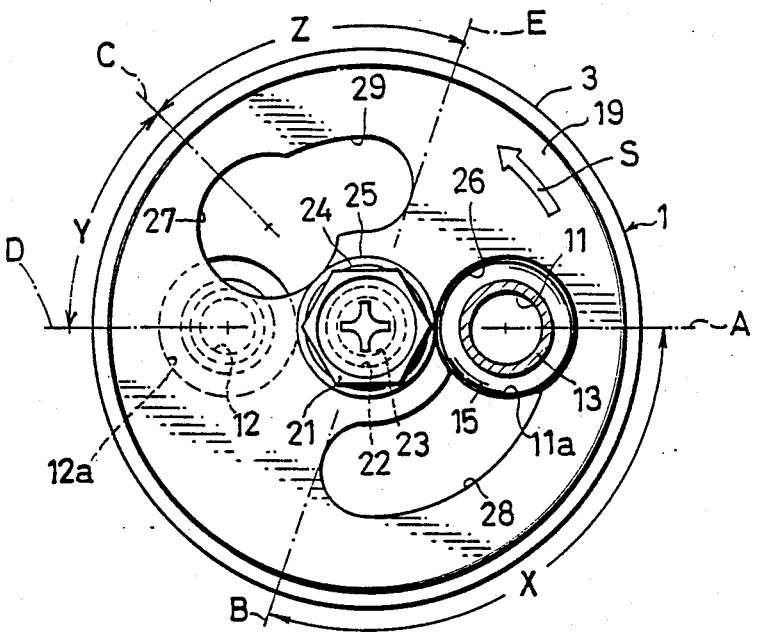
FIG. 4 is a view corresponding to FIG. 3 and showing how to fix the refrigerant pipes to the tank top wall, with the inlet refrigerant pipe only inserted in an inlet refrigerant channel.

The pipe fixing plate 19 is formed with two circular holes 26, 27 approximately equal in diameter to the outside diameter of the respective annular projections 15, 16 for the projections 15, 16 to pass therethrough. The hole 26 for passing the annular projection 15 of the inlet refrigerant pipe 13 through will hereinafter be referred to as the "first circular hole," and the hole 27 for passing the annular projection 16 of the outlet refrigerant pipe 14 through as the "second circular hole." In communication with the respective circular holes 26, 27 at a peripheral portion of each hole are pipe inserting cutouts 28, 29 extending therefrom in the same circumferential direction about the screw hole 22 so as to be positioned on a circle concentric with the screw hole 22 when seen from above. The cutouts 28, 29 have a width not permitting the respective annular projections 15, 16 to pass therethrough. The cutout 28 extending from the first circular hole 26 will hereinafter be referred to as the "first cutout," and the cutout 29 extending from the second circular hole 27 as the "second cutout." The forward end of each of the pipe inserting cutouts 28, 29 is in a circular-arc form in conformity with the outer periphery of the vertical portion 13*a* (14*a*) of the refrigerant pipe 13 (14). With reference to FIG. 4, the angle X made by a line A through the center of the first circular hole 26 and the center of the screw hole 22 with a line B through the forward end of the first cutout 28 and the center of the screw hole 22 is equal to the angle Y made by a line C through the center of the second circular hole 27 and the center of the screw hole 22 with a line D through the center of outer end of the outlet refrigerant channel 12 and the center of the screw hole 22 when the first circular hole 26 is positioned immediately above the outer end of the inlet refrigerant channel 11, plus the angle Z made by the line C through the center of the second circular hole 27 and the center of the screw hole 22 with a line E through the forward end of the second cutout 29 and the center of the screw hole 22.

Figure 5:
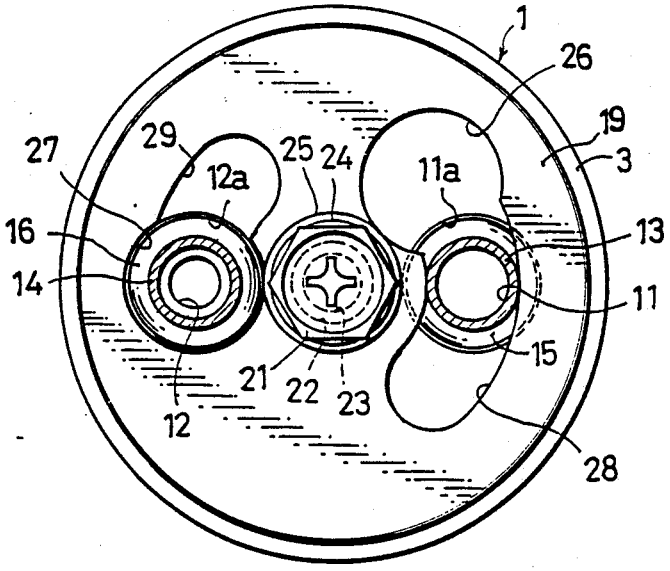
FIG. 5 is a view corresponding to FIG. 3 and showing how to fix the refrigerant pipes to the tank top wall, with the outlet refrigerant pipe inserted in an outlet refrigerant channel after the inlet pipe has been inserted into the inlet channel.

The inlet and outlet refrigerant pipes 13, 14 are fixed to the top wall 3 by the method to be described below with reference to FIGS. 4 and 5.

First, the screw 21 is slightly loosened to render the pipe fixing plate 19 free to rotate about the shank 21*b* of the screw 21. The fixing plate 19 is rotated to position the first circular hole 26 immediately above the outer end of the inlet refrigerant channel 11, and the inner end of the inlet pipe 13 is inserted into the inlet channel 11 with the annular projection 15 fitted in the enlarged portion 11*a* along with the seal 17 (see FIG. 4). The fixing plate 19 is then rotated through the angle Y in the direction of arrow S in FIG. 4. At this time, the annular projection 15 of the inlet pipe 13 is pressed on by the inner and outer side edges of the first cutout portion 28 at an intermediate portion of the length of the cutout 28, whereby the inlet pipe 13 is temporarily held. On the other hand, the second circular hole 27 is positioned immediately above the upper end of the outlet channel 12. The outer end of the outlet pipe 14 is inserted into the outlet channel 12 with the annular projection 16 fitted in the enlarged portion 12*a* along with the seal 18 (see FIG. 5). The pipe fixing plate 19 is thereafter rotated further in the direction of arrow S to position the refrigerant pipes 13, 14 at the forward ends of the cutouts 28, 29, respectively with their outer peripheries partly brought into intimate contact with the ends of the cutout portions 28, 29. At this time, the annular projection 15 (16) of the pipe 13 (14) is pressed on by the inner and outer side edges and the circular-arc end edge of the cutout portion 28 (29), whereby the pipe 13 (14) is temporarily held in place. In this state, the refrigerant pipe 13 (14) is freely rotatable about the axis of the refrigerant channel 11 (12) and is therefore rotated to orient the horizontal portion 13*a* (14*a*) of the pipe 13 (14) toward the desired direction. Finally, the screw 21 is tightened up to fasten the fixing plate 19 to the top wall 3 and fix the two refrigerant pipes 14, 14 to the top wall 3.

Figure 6:
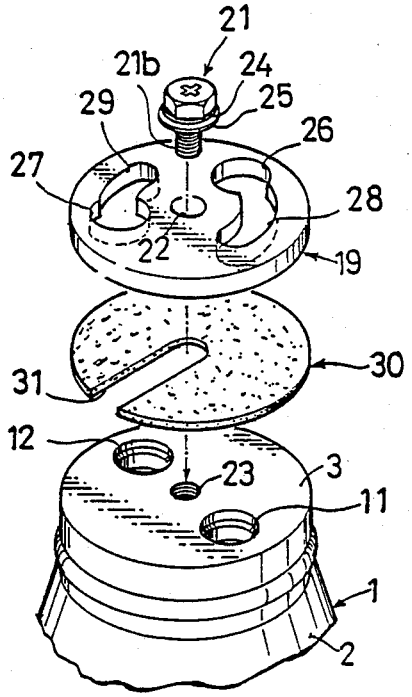
FIG. 6 an exploded perspective view showing a method of preventing dust or the like from ingressing into the closed tank.
Figure 7:
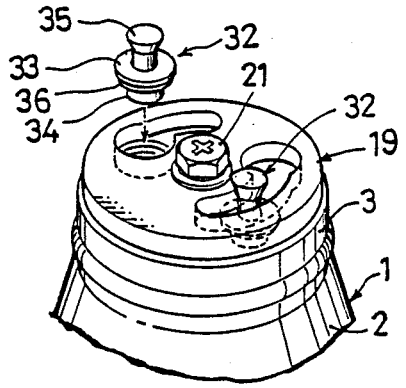
FIG. 7 is an exploded perspective view showing another method of preventing dust or the like from ingressing into the closed tank.

With such receivers, the inlet and outlet refrigerant pipes 13, 14 are fixed to the top wall 3 of the closed tank 1, generally at the site where motor vehicle air conditioners with the receiver are assembled. In this case, it is desirable to transport the closed tank 1 to the site of assembly with the open outer ends of the inlet and outlet refrigerant channels 11, 12 closed as seen in FIGS. 6 or 7 to thereby prevent dust from ingressing into the tank 1 or to preclude the drying agent within the tank 1 from absorbing water. With the method shown in FIG. 6, a circular gasket 30 having a generally U-shaped cutout 31 is interposed between the top wall 3 and the pipe fixing plate 19 with the screw shank 21*b* positioned in the cutout 31, and the screw 21 is tightened up to close the outer end openings of the refrigerant channels 11, 12 with the gasket 30.

With the method shown in FIG. 7, the outer end openings of the inlet and outlet refrigerant channels 11, 12 are closed with plugs 32. The plug 32 comprises a disk portion 33 fittable in the enlarged portion 11*a* or 12*a* of the channel 11 or 12, a closure portion 34 projecting downward from the lower surface of the disk portion 33 and insertable into the channel 11 or 12, a knob 35 projecting upward from the upper surface of the disk portion 33 and an O-ring 36 fitted around the closure portion 34. Like the pipes 13, 14, the plugs 32 are fixed to the top wall 3.

Figure 8:
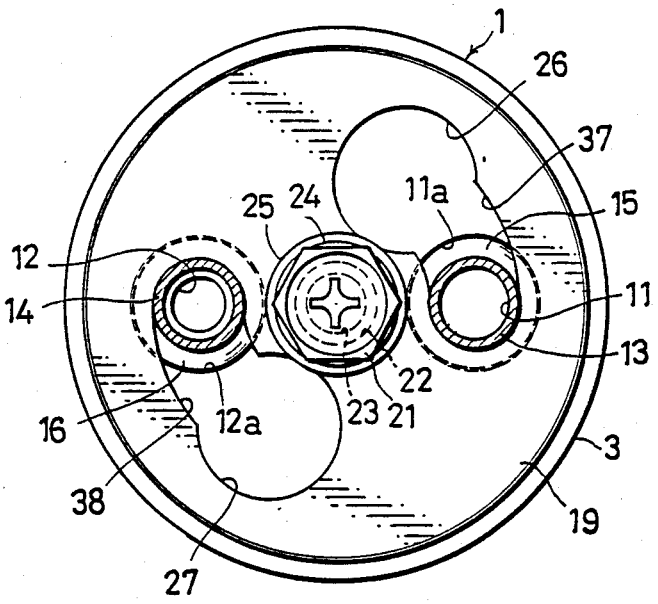
FIG. 8 is a view corresponding to FIG. 3 and showing another embodiment of the invention.

With reference to FIG. 8 showing another embodiment of the invention, two circular holes 26, 27 formed in a pipe fixing plate 19 of the receiver can be positioned immediately above the outer ends of the inlet and outlet refrigerant channels 11, 12 at the same time. When the first circular hole 26 is positioned immediately above the outer end of the inlet channel 11, a line C through the center of the second circular hole 27 and the center of the screw hole 22 (see FIG. 4) makes an angle Y (see FIG. 4) of zero degree with the line D through the center of the outer end of the outlet refrigerant channel 12 and the center of the screw hole 22 (see FIG. 4). Pipe inserting cutouts 37, 38 of the same length are formed in communication with the respective circular holes 26, 27, each at a peripheral portion of the hole. With the exception of the above feature, the present embodiment has the same construction as the first.

The inlet and outlet refrigerant pipes 13, 14 are fixed to the top wall 3 in the following manner. First, the screw 21 is slightly loosened to render the pipe fixing plate 19 free to rotate around the screw 21. The fixing plate 19 is then rotated to position the two circular holes 26, 27 immediately above the outer ends of the inlet and outlet refrigerant channels 11, 12, respectively, and the outer ends of the inlet and outlet pipes 13, 14 are inserted into the inlet and outlet channels 11, 12, respectively, with the annular projections 15, 16 fitted in the enlarged portions 11*a*, 12*a* along with the seals 17, 18. The same procedure as in the first embodiment then follows. Finally, the screw 21 is tightened up to fasten the fixing plate 19 to the top wall 3 and fix the two refrigerant pipes 13, 14 to the wall 3.

With the foregoing two embodiments, the angle X made by the line A through the center of the first circular hole 26 and the center of the screw hole 22 with the line B through the forward end of the first cutout 28 and the center of the screw hole 22 is equal to the sum of the angle Y and the angle Z, the angle Y being made by the line C through the center of the second circular hole 27 and the center of the screw hole 22 with the line D through the center of outer end of the outlet refrigerant channel 12 and the center of the screw hole 22 when the first circular hole 26 is positioned immediately above the outer end of the inlet refrigerant channel 11, the angle Z being made by the line C with the line E through the forward end of the second cutout 29 and the center of the screw hole 22. However, the angle X need not always be as defined above; the arrangement is useful insofar as the angle X is greater than the angle Y.

Figure 9:
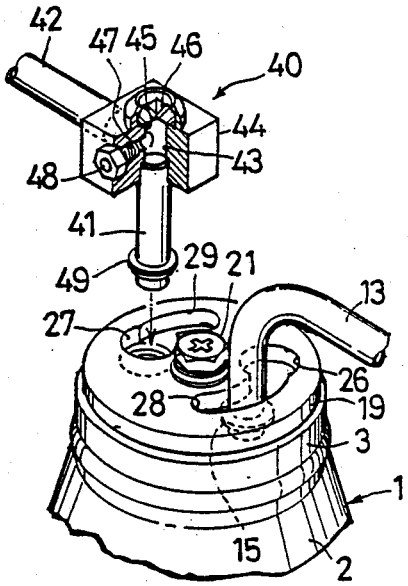
FIG. 9 is an exploded perspective view partly broken away and showing a modified outlet refrigerant pipe.
Figure 10:
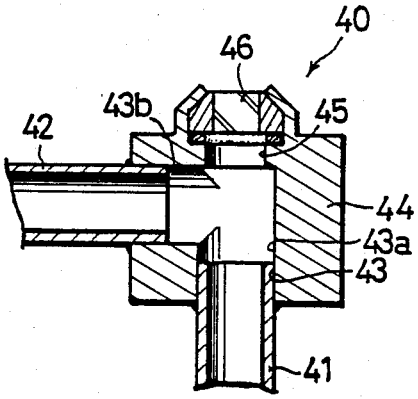
FIG. 10 is a view in vertical section showing a portion of the outlet refrigerant pipe shown in FIG. 9.

With reference to FIGS. 9 and 10 showing a modified outlet refrigerant pipe 40, the pipe 40 comprises a vertical segment 41 and a horizontal segment 42 interconnected in communication with each other by a block joint 44 having a refrigerant passage 43. The refrigerant passage 43 comprises a vertical portion 43*a* having an open lower end at the lower surface of the block joint 44 and an upper end at an intermediate point of the height of the joint 44, and a horizontal portion 43*b* extending horizontally sidewise from the upper end of the vertical portion 43*a* and having an open outer end at a side surface of the joint 44. The vertical pipe segment 41 is fixedly inserted in the lower end of the refrigerant passage horizontal portion 43*a*, and the horizontal pipe segment 42 is fixedly inserted in the outer side end of the horizontal passage portion 43*b*. A refrigerant inspection bore 45 extends upward from the upper end of the vertical passage portion 43*a* through the block joint 44 and is closed with a sight glass 46. A bore 47 communicating with the refrigerant passage 43 is formed in one of the two sides of the block joint 44 which are opposed to each other perpendicular to the horizontal segment 42. The bore 47 is closed with a meltable stopper 48 made of a metal having a low melting point. The vertical segment 41 is formed with an annular projection 49 fittable in the enlarged portion 12*a* of the outlet refrigerant channel 12.

Figure 11:
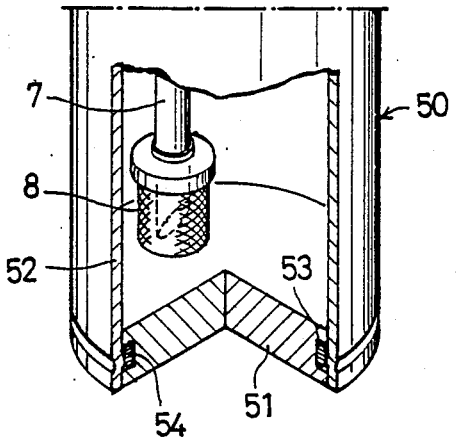
FIG. 11 is a perspective view partly broken away and showing a modified closed tank.

With reference to FIG. 11 showing a modified closed tank 50, the tank 50 has a bottom wall 51 made of a thick plate which is separate from the peripheral wall 52 of the tank, fitted in the lower end opening of the peripheral wall 52 and held to the wall 52 by crimping. An annular groove 53 formed in the periphery of the bottom wall 51 over the entire circumference thereof has fitted therein an O-ring 54 made of the same metal of low melting point as the meltable stopper 48.

Figure 12:
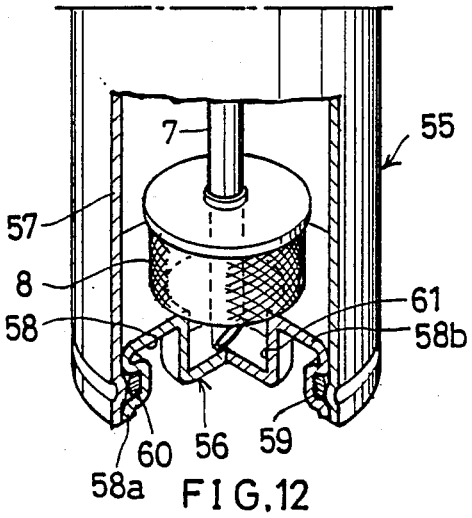
FIG. 12 is a perspective view partly broken away and showing another modified closed tank.

With reference to FIG. 12 showing another modified closed tank 55, the bottom wall 56 of the tank has a peripheral plate 58*a* and a bottom plate 58*b* which define a cavity 58. The bottom wall 56 is fitted in the peripheral wall 57 of the tank with the peripheral plate 58*a* in intimate contact with the inner surface of the wall 57 and held to the wall 57 by crimping. An annular groove 59 formed in the outer side of the cavity-defining peripheral plate 58*a* is fitted with an O-ring 60 made of the same metal of low melting point as the meltable stopper 48. The cavity-defining bottom plate 58*b* is centrally formed with a downwardly projecting recessed portion 61. The aspirating tube 7 extending downward through the strainer 8 has a lower end positioned inside the recessed portion 61. The strainer 8 rests on the bottom plate 58*b* to close the upper end opening of the recessed portion 61.

In the case of the closed tanks 50, 55 shown in FIGS. 11 and 12, the top wall of the tank may be integral with the peripheral wall 52 or 57 of the tank.

What is claimed is:

1. A receiver comprising:

a closed tank having a top wall with a planar upper surface, the top wall being formed with a blind screw bore and two refrigerant channels each having an outer end opened at the upper surface of the top wall and an enlarged portion at the outer end, inlet and outlet refrigerant pipes connected to the top wall and inserted each at its one end in the respective refrigerant channels, each of the refrigerant pipes having an annular projection formed on its outer periphery over the entire circumference thereof and fitted in the enlarged portion of the refrigerant channel, a pipe fixing plate having a planar lower surface and disposed over the upper surface of the top wall for fixing the refrigerant pipes to the tank top wall, the pipe fixing plate being formed with a screw hole, two circular holes each having a diameter approximately equal to the outside diameter of the annular projection for the annular projection to pass therethrough, and pipe inserting circular-arc cutouts communicating with the respective circular holes each at a peripheral portion of the hole and extending in the same circumferential direction about the screw hole so as to be positioned on a circle concentric with the screw hole when seen from above, each of the circular-arc cutouts having a width not permitting the annular projection to pass therethrough, and a screw extending through the screw hole of the pipe fixing plate and screwed into the blind screw bore in the top wall for fastening the pipe fixing plate to the tank top wall, the angle made by a line through the center of one of the circular holes in the pipe fixing plate and the center of the screw hole therein with a line through the forward end of the cutout communicating with said one circular hole and the center of the screw hole being greater than the angle made by a line through the center of the other circular hole in the pipe fixing plate and the center of the screw hole with a line through the center of one of the refrigerant channels in the top wall and the center of the screw hole when said one circular hole is positioned immediately above the outer end of the other refrigerant channel.

2. A receiver as defined in claim 1 wherein the forward end of each pipe inserting cutout has a circular-arc form in conformity with the outer periphery of the refrigerant pipe, and the first-mentioned angle is equal to the second-mentioned angle plus the angle made by the line through the center of said other circular hole and the center of the screw hole with a line through the forward end of the cutout communicating with said other circular hole and the center of the screw hole.

3. A receiver as defined in claim 1 or 2 wherein when one of the circular holes in the pipe fixing plate is positioned immediately above the outer end of one of the refrigerant channels, and the other circular hole is located out of coincidence with the position immediately above the outer end of the other refrigerant channel.

4. A receiver as defined in claim 1 or 2 wherein when one of the circular holes in the pipe fixing plate is positioned immediately above the outer end of one of the refrigerant channels, and the other circular hole is positioned immediately above the outer end of the other refrigerant channel.

5. A receiver as defined in claim 1 wherein each of the refrigerant pipe comprises a vertical portion connected at its lower end to the top wall and a horizontal portion communicating with the upper end of the vertical portion.

6. A receiver as defined in claim 5 wherein the outlet refrigerant pipe comprises a vertical segment and a horizontal segment interconnected by a block joint, and the block joint has a passage for holding the vertical segment in communication with the horizontal segment, a bore communicating with the passage for inspecting a refrigerant flowing through the passage, and a sight glass fitted in the inspecting bore.

7. A receiver as defined in claim 6 wherein the block joint is formed with a bore communicating with the passage and having a meltable stopper fitted therein.

* * * * *